US012628951B2

(12) United States Patent
Chang et al.

(10) Patent No.: US 12,628,951 B2
(45) Date of Patent: May 19, 2026

(54) CABINET

(71) Applicant: Fulian Precision Electronics (Tianjin) Co., LTD., Tianjin (CN)

(72) Inventors: Chih-Feng Chang, Tu-Cheng (TW); Kuo-Chih Hung, New Taipei (TW); Hung-Liang Chung, New Taipei (TW)

(73) Assignee: Fulian Precision Electronics (Tianjin) Co., LTD., Tianjin (CN)

( * ) Notice: Subject to any disclaimer, the term of this patent is extended or adjusted under 35 U.S.C. 154(b) by 0 days.

(21) Appl. No.: 18/792,857

(22) Filed: Aug. 2, 2024

(65) Prior Publication Data

US 2025/0057316 A1 Feb. 20, 2025

(30) Foreign Application Priority Data

Aug. 16, 2023 (CN) ..... 202311041452.X

(51) Int. Cl.
*A47B 96/00* (2006.01)
*A47B 96/06* (2006.01)

(52) U.S. Cl.
CPC ..... *A47B 96/06* (2013.01); *A47B 2220/0022* (2013.01); *A47B 2220/0036* (2013.01)

(58) Field of Classification Search
None
See application file for complete search history.

(56) References Cited

U.S. PATENT DOCUMENTS 9,913,398 B1 * 3/2018 Chen ..... F16L 3/015
11,698,502 B2 * 7/2023 Anderson ..... H02G 3/0608 385/100
2004/0035983 A1 * 2/2004 Simonson ..... H02G 15/117 248/49
2009/0038845 A1 * 2/2009 Fransen ..... H04Q 1/021 174/72 R
2013/0056433 A1 * 3/2013 Von De Linde ..... A47B 96/07 211/134
2014/0001315 A1 * 1/2014 Mcneal ..... H04Q 1/13 248/67.7
2015/0068992 A1 * 3/2015 Chen ..... H02G 11/006 248/70
2016/0161026 A1 * 6/2016 Chen ..... H05K 7/1491 248/70
2016/0215904 A1 * 7/2016 Chen ..... H02G 3/32
2021/0127515 A1 * 4/2021 Wang ..... H05K 5/0221
2022/0196185 A1 * 6/2022 Guyatt ..... F16L 3/2235
2022/0386497 A1 * 12/2022 Wang ..... H05K 7/1489
2024/0032233 A1 * 1/2024 Alvarado ..... H05K 7/20136
2025/0125598 A1 * 4/2025 Sam ..... H05K 7/1491

FOREIGN PATENT DOCUMENTS

TW M606170 U 1/2021
TW M635191 U 12/2022

* cited by examiner

*Primary Examiner* — Steven M Marsh
(74) *Attorney, Agent, or Firm* — ScienBiziP, P.C.

(57) ABSTRACT

A cabinet includes a cabinet body and a bracket. The bracket includes a connecting frame and two adjustment assemblies. Each of the adjustment assemblies comprises a first end and a second end away from the first end, the first end of each of the adjustment assemblies is connected to the connecting frame, the second end of each of the adjustment assemblies is rotatably connected to the cabinet body, a distance between the first end and the second end of each of the adjustment assemblies is adjustable.

15 Claims, 14 Drawing Sheets

CABINET

FIELD

The subject matter herein generally relates to a field of data transmission, and in particular to a cabinet.

BACKGROUND

Cabinets are used to assemble transmission medias, which may be optical fiber cables for transmitting data. Since there are unified standards for cabinet sizes, the space in the cabinet for assembling fiber optic cables is limited.

Therefore, there is room for improvement within the art.

BRIEF DESCRIPTION OF THE DRAWINGS

Implementations of the present disclosure will now be described, by way of embodiments, with reference to the attached figures.

DETAILED DESCRIPTION

Figure 1:
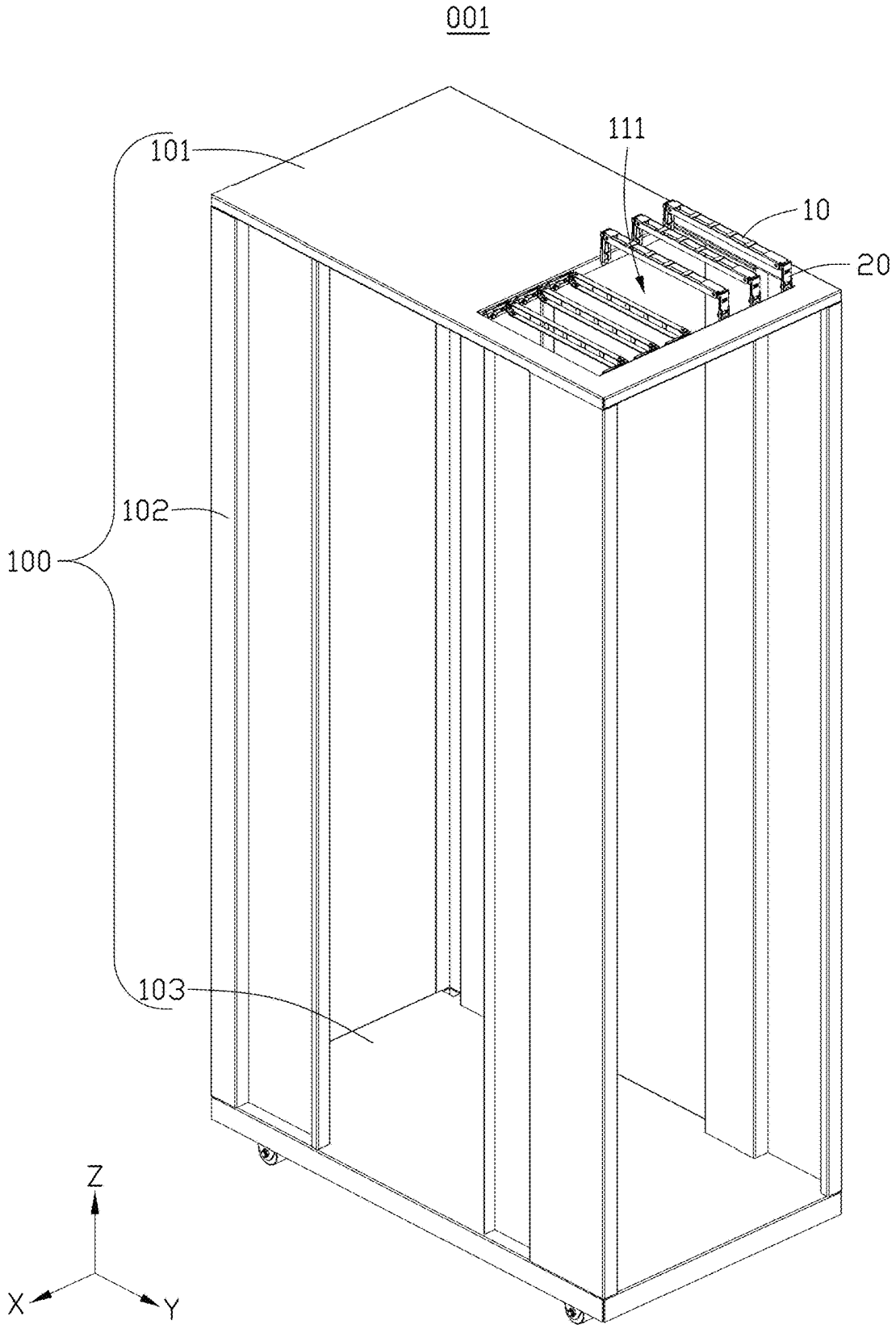
FIG. 1 is a schematic diagram illustrating a cabinet according to an embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain parts may be exaggerated to better illustrate details and features of the present disclosure.

The disclosure is illustrated by way of example and not by way of limitation in the figures of the accompanying drawings, in which like references indicate similar elements. It should be noted that references to "an" or "one" embodiment in this disclosure are not necessarily to the same embodiment, and such references mean "at least one."

The term "comprising," when utilized, means "including, but not necessarily limited to"; it specifically indicates open-ended inclusion or membership in the so-described combination, group, series, and the like.

When two elements (planes, lines) are arranged in parallel, it should be understood that a relationship between the two elements includes two types: parallel and approximately parallel. Approximately parallel should be understood to mean that there may be a certain included angle between the two elements, and the included angle is greater than 0° and less than or equal to 10°.

When two elements (planes, lines) are arranged vertically, it should be understood that a relationship between the two elements includes vertical and approximately vertical. Approximately vertical should be understood to mean that an included angle between the two elements is greater than or equal to 80° and less than 90°.

When a parameter is greater than, equal to, or less than a certain endpoint value, it should be understood that the endpoint value is allowed a tolerance of ±10%. For example, A is 10 greater than B, which should be understood to include A being 9 greater than B and A being 11 greater than B.

Figure 5:
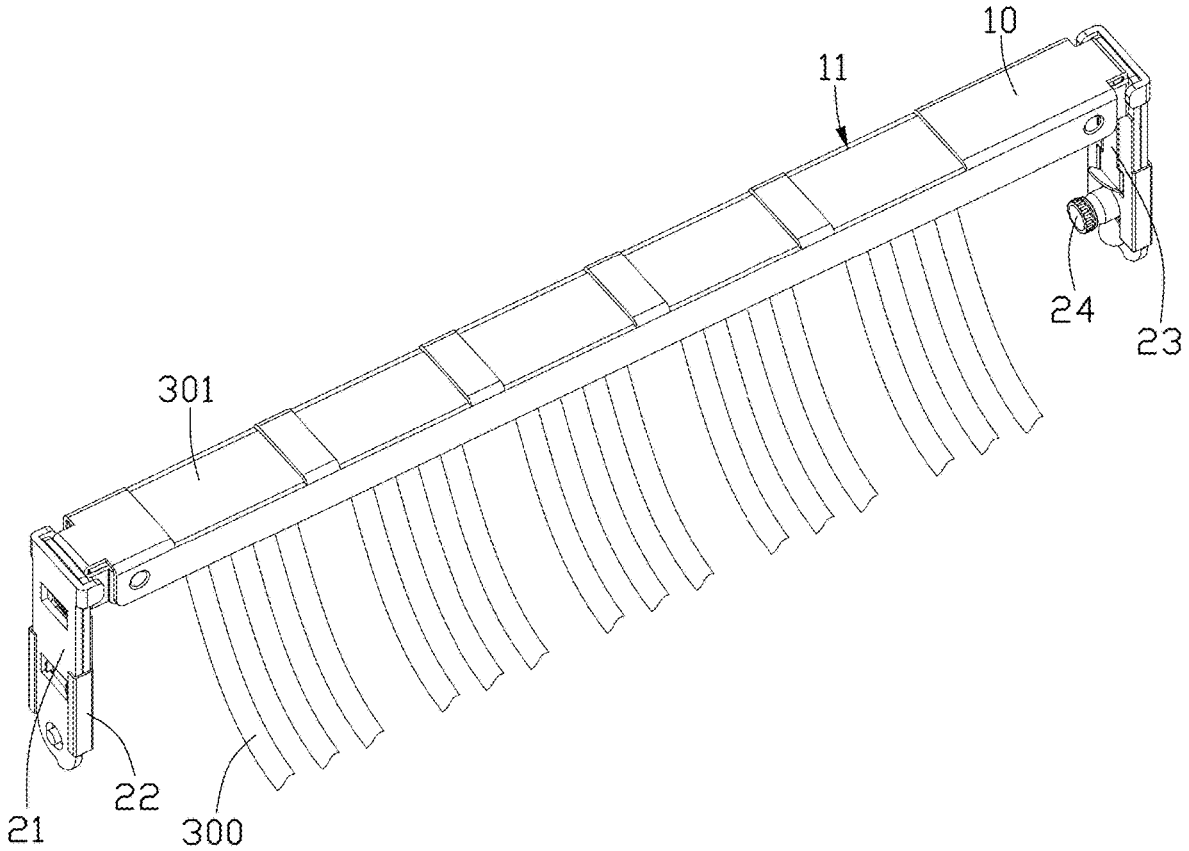
FIG. 5 is a schematic diagram illustrating a bracket, connectors, and optical fiber cables according to an embodiment of the present disclosure.
Figure 6:
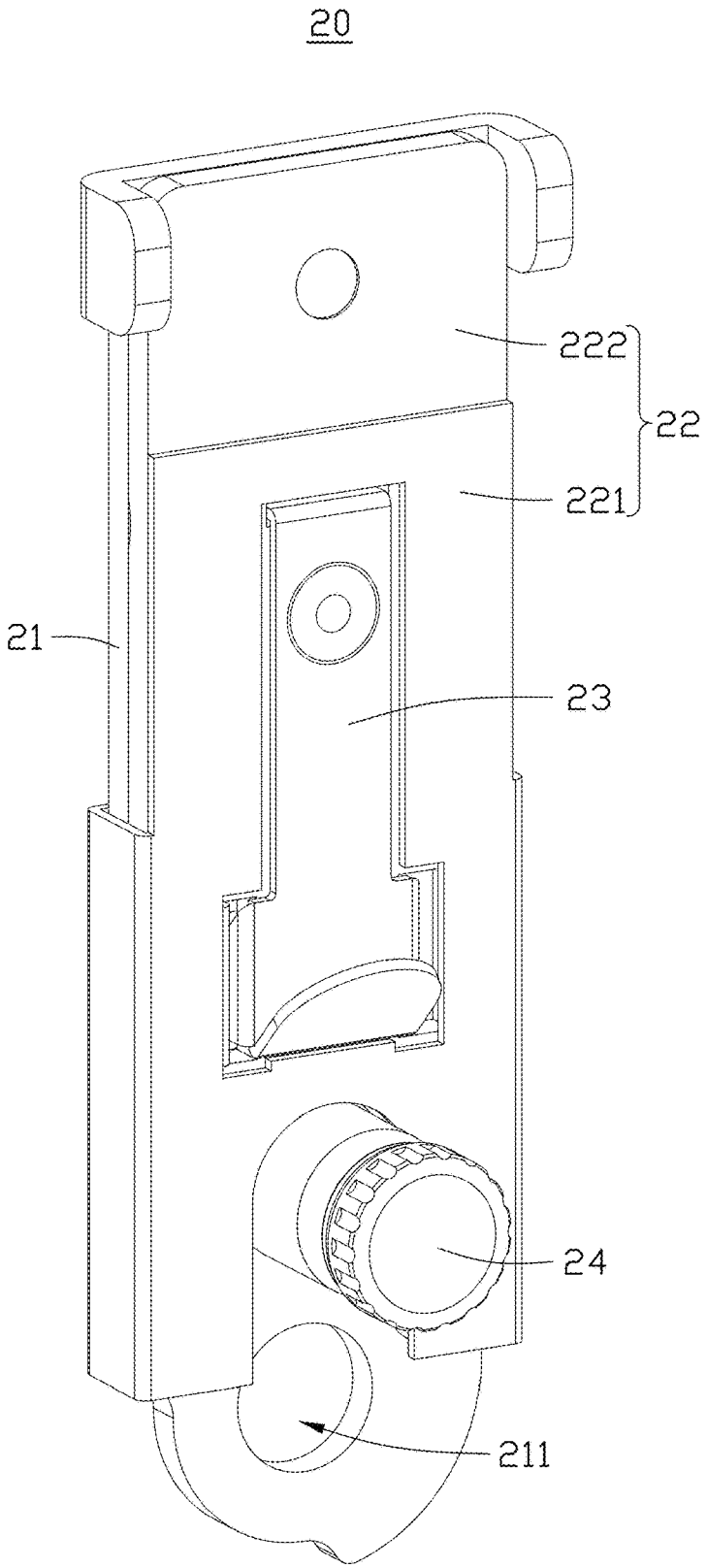
FIG. 6 is a schematic diagram illustrating an adjustment assembly according to an embodiment of the present disclosure.
Figure 7:
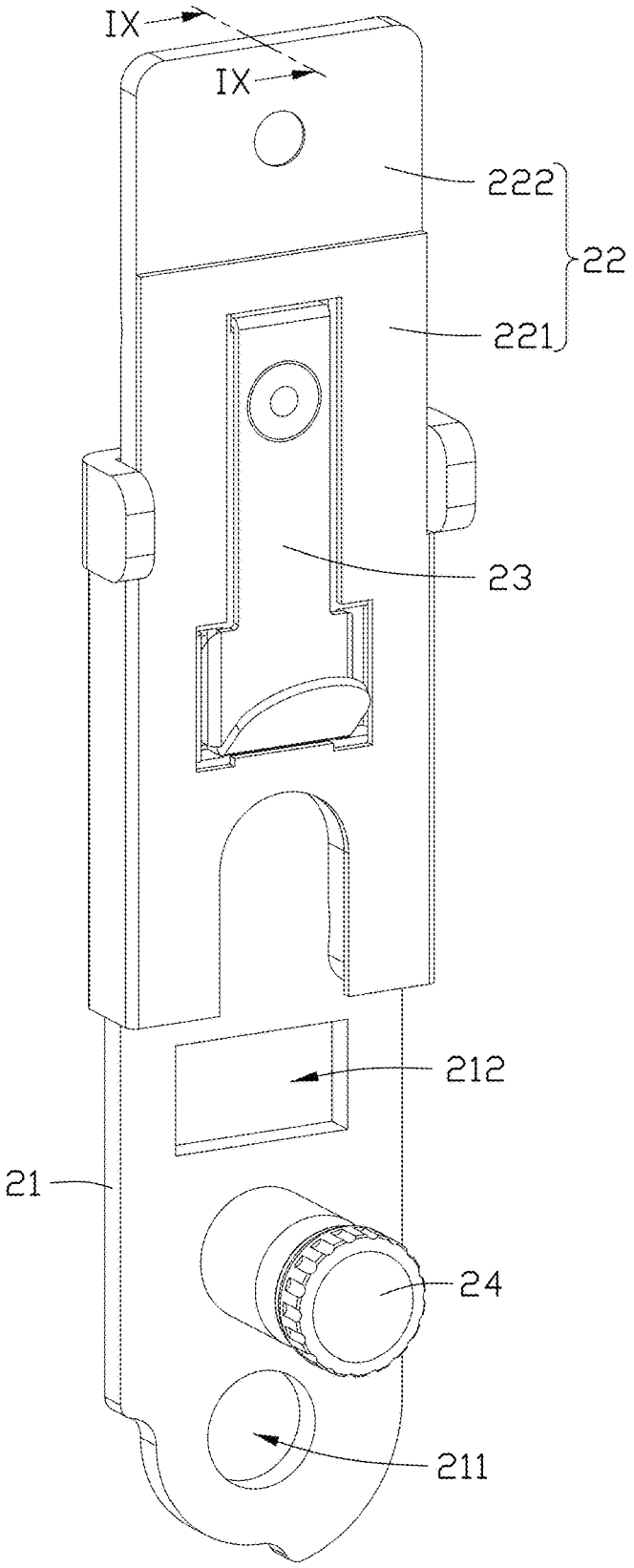
FIG. 7 is a schematic diagram illustrating the adjustment assembly of FIG. 6 in another state according to an embodiment of the present disclosure.

FIG. 1 illustrates an embodiment of a cabinet 001. The cabinet 001 includes a cabinet body 100 and at least one bracket 200. When the cabinet 001 includes a plurality of brackets 200, the plurality of brackets 200 is arranged in the cabinet body 100 at intervals. A transmission media is at least partially located in the cabinet body 100 and connected to the at least one bracket 200. The transmission media includes but is not limited to twisted pairs, coaxial cables, or optical fiber cables 300 (as shown in FIG. 5). In at least one embodiment, the transmission media includes optical fiber cables 300.

In order to describe the cabinet 001 of various embodiments of the present application more clearly, a coordinate system is established in FIG. 1. Subsequent descriptions of various directions of the cabinet 001 are based on this coordinate system. Referring to FIG. 1, a first direction X is parallel to the X-axis, a width of the cabinet 001 extends along the first direction X, a plurality of brackets 200 is spaced apart along the first direction X. The Y axis is perpendicular to the X axis in a horizontal plane, a second direction Y is parallel to the Y axis, and a length of the cabinet 001 extends along the second direction Y. The Z axis is perpendicular to a plane formed by the X axis and the Y axis, a third direction Z is parallel to the Z axis, and a height of cabinet 001 extends along the third direction Z. In the description of this application, the terms "above", "below", "upward" and "downward" are all relative to the third direction Z.

Figure 2:
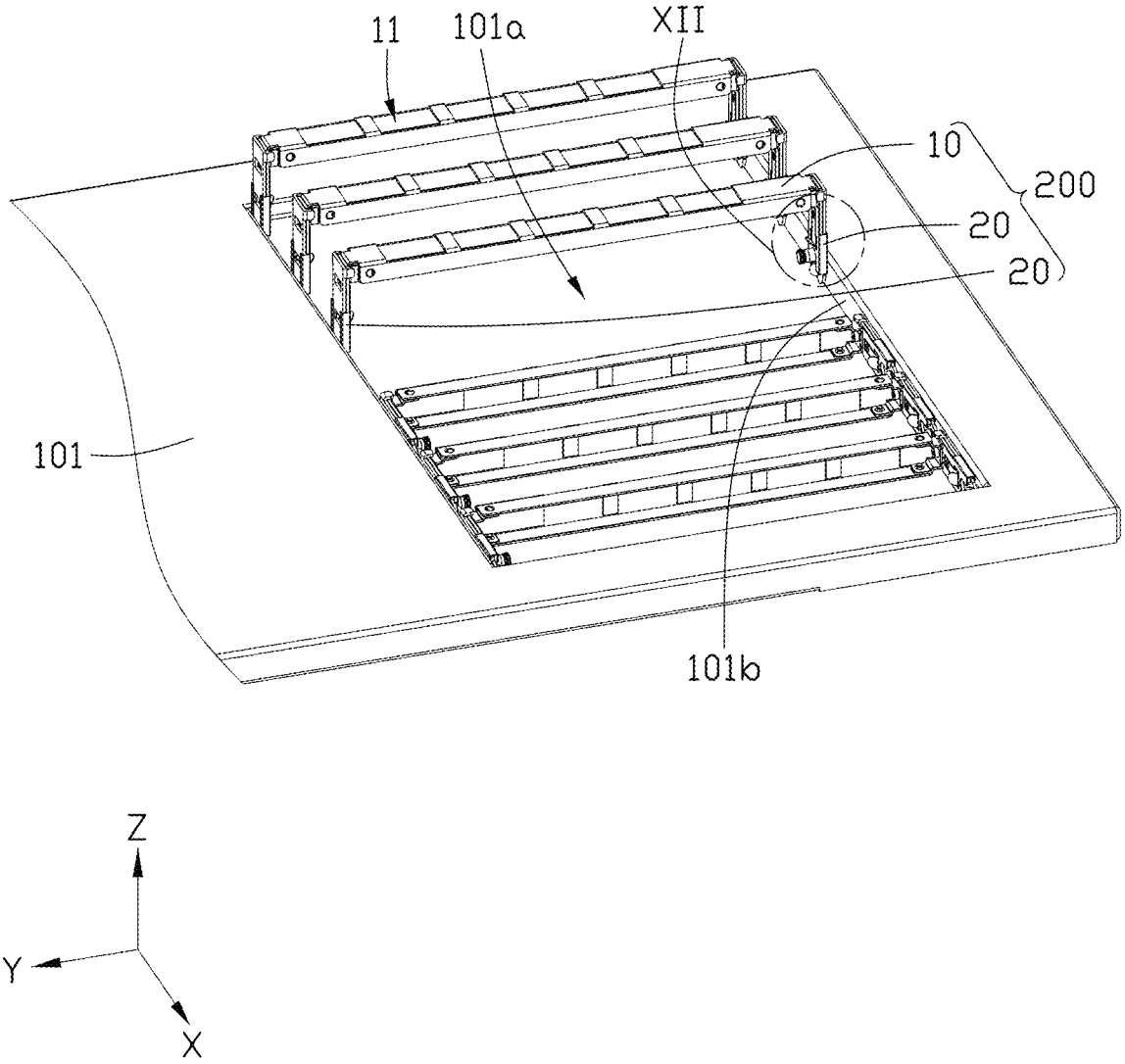
FIG. 2 is a schematic diagram illustrating a partial structure of a cabinet according to an embodiment of the present disclosure.
Figure 3:
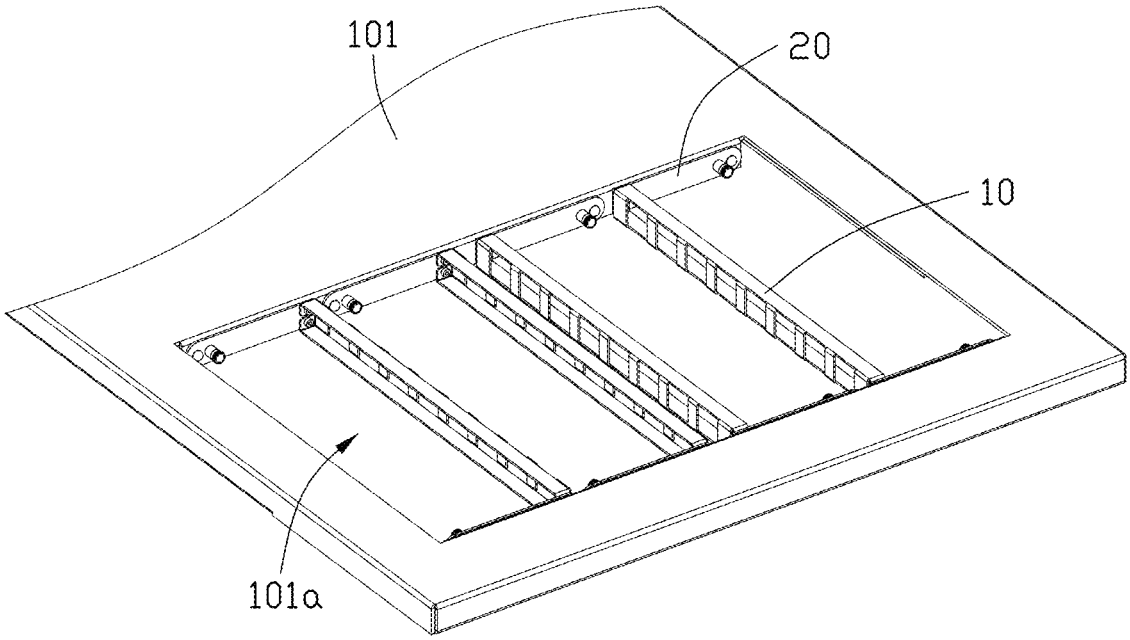
FIG. 3 is a schematic diagram illustrating a partial structure of a cabinet in the related art.
Figure 4:
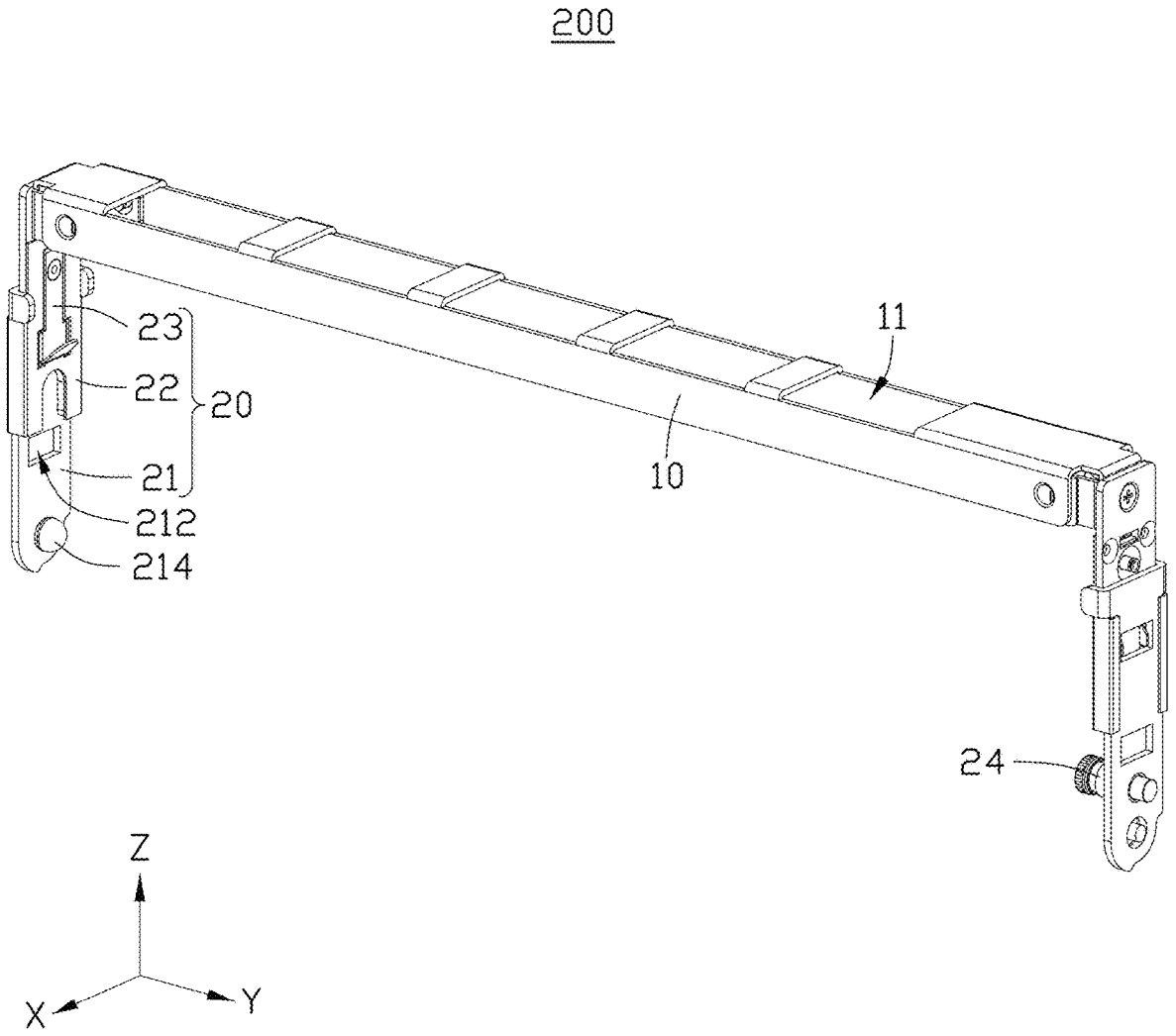
FIG. 4 is a schematic diagram illustrating a bracket according to an embodiment of the present disclosure.

Referring to FIG. 1, FIG. 2, and FIG. 3, each bracket 200 includes a connecting frame 10 and two adjustment assemblies 20. The connecting frame 10 includes a plurality of mounting slots 11 for installing connectors 301 (shown in FIG. 5). An end of each optical fiber cable 300 is connected to one of the connectors 301. The adjustment assemblies 20 are arranged in the cabinet body 100 at intervals in the second direction Y, and located at opposite sides of the connecting frame 10. A first end of each of the adjustment assemblies 20 is connected to the connecting frame 10, a second end of each of the adjustment assemblies 20 is rotationally connected to the cabinet body 100. A rotation axis of each of the adjustment assemblies 20 extends along the second direction Y, so that the connecting frame 10 can rotate between a first position and a second position. When the connecting frame 10 is located in the first position, the connecting frame 10 is in a stowed state, and when the connecting frame 10 is located in the second position, the connecting frame 10 is in an extended state. When the connecting frame 10 is in the stowed state, the connecting frame 10 can be received in the cabinet body 100. When the connecting frame 10 is in the extended state, the connecting frame 10 extends out of the cabinet body 100, and the adjustment assemblies 20 are stretchable to adjust the length.

By rotating the adjustment assemblies 20 relative to the cabinet body 100, the connecting frame 10 can be switched between the stowed state and the extended state, so that the connecting frame 10 is received in the cabinet body 100 or extends out of the cabinet body 100.

When transporting the cabinet 001, the connecting frames 10 can be received in the cabinet body 100, so that the connecting frames 10 will not protrude from the six directions of the cabinet 001, and multiple cabinets 001 can be stacked to improve space utilization. The connecting frames 10 received in the cabinet body 100 can also reduce the occurrence of accidental collision with the brackets 200 when transporting the cabinet 001, thereby helping to prevent the brackets 200 from being skewed and damaged. When the cabinet 001 needs to be assembled with the optical fiber cables 300, the adjustment assemblies 20 can be rotated so that the connecting frame 10 extends out od the cabinet body 100, thereby increasing an installation space for installing the optical fiber cables 300. Since the optical fiber cables 300 needs to be bent and extended out of the cabinet body 100, and materials of the optical fiber cables 300 includes glass, when the optical fiber cables 300 are excessively curled or even bent, the optical fiber cables 300 will be damaged. By increasing the installation space for installing the optical fiber cables 300, not only there can be enough space to arrange and install the optical fiber cables 300, but also the curvature of the optical fiber cables 300 can be reduced, thereby reducing damage to the optical fiber cables 300.

Each of the adjustment assemblies 20 may be stretchable along its own extension direction to adjust its own length. That is, each of the adjustment assemblies 20 can stretch and contract along a connecting direction of its first end connected to the connecting frame 10 and its second end connected to the cabinet body 100. When the connecting frame 10 is in the stowed state, the adjustment assembly 20 adjust its length along the first direction X. When the connecting frame 10 is in the extended state, the adjustment assembly 20 adjust its length along the third direction Z. When the connecting frame 10 is received in the cabinet body 100, the length of the adjustment assembly 20 can be shortened to a shortest state, at this time, the length of the adjustment assembly 20 in the first direction X is small, so that when the size of the cabinet body 100 remains unchanged, more brackets 200 spaced apart along the first direction X can be installed. When the connecting frame 10 extends out of the cabinet body 100, the length of the adjustment assembly 20 can be extended to a longest state, at this time, the length of the adjustment assembly 20 in the third direction Z is long, and the installation space for installing the optical fiber cables 300 in the third direction Z is large, so as to facilitate the installation of the optical fiber cables 300.

The cabinet body 100 may include a top plate 101, side plates 102, and a bottom plate 103. The top plate 101 and the bottom plate 103 are spaced apart along the third direction Z and may be arranged horizontally. One end of each of the side plates 102 is connected to the top plate 101, and another end of each of the side plates 102 is connected to the bottom plate 103. Each of the side plates 102 may be arranged vertically. The top plate 101 may be located between the connecting frame 10 in the first position and the connecting frame 10 in the second position, so that the connecting frame 10 can be received in the cabinet body 100 when the connecting frame 10 is in the first position. In at least one embodiment, the number of the side plates 102 is four, and the cabinet body 100 may be roughly in a shape of a rectangular parallelepiped. The side plates 102 of the cabinet body 100 may be hollowed to facilitate the organization of the optical fiber cables 300.

In at least one embodiment, the top plate 101 includes an inner wall 101*b* for defining a mounting slot 101*a*, and the mounting slot 101*a* may penetrate the top plate 101 along the third direction Z. The second end of each of the adjustment assemblies 20 is rotatably connected to the inner wall 101 defining the mounting slot 101*a*. When the connecting frame 10 is in the first position, the connecting frame 10 can be received in the mounting slot 101*a*, and when the connecting frame 10 is in the second position, the connecting frame 10 extends out of the mounting slot 101*a*. By arranging the mounting slot 101*a*, the position for installing the adjustment assemblies 20 can be provided, and at least part of the optical fiber cables 300 connected to the connecting frames 10 can extend vertically into the cabinet body 100. It can be understood that the adjustment component 20 is not limited to being connected to the inner wall 101*b*. For example, an end of each of at least one connecting piece may be arranged on an upper surface of the top plate 101, the at least one connecting piece extends toward the mounting slot 101*a*, and at least one of the adjustment assemblies 20 is rotatably connected to another end of each of at least one connecting piece.

Referring to FIGS. 1, 2 and 4 to 7, each of the adjustment assemblies 20 may include a rotating member 21, a sliding member 22, and a limiting member 23. One end of the rotating member 21 is rotatably connected to the cabinet body 100, and a rotation axis of the rotating member 21 extends along the second direction Y, so that another end of the rotating member 21 can be rotated outside the mounting slot 101*a*. The sliding member 22 is slidingly connected to the rotating member 21, so that each of the adjustment assemblies 20 can be stretchable to adjust its length along a sliding direction of the sliding member 22. An end of the sliding member 22 away from the end of the rotating member 21 connected to the cabinet body 100 is connected to the connecting frame 10. The limiting member 23 is arranged on the sliding member 22, and when the sliding member 22 slides relative to the rotating member 21 to a preset position, the limiting member 23 and the rotating member 21 are limitedly engaged.

By rotating the rotating member 21, the connecting frame 10 can be driven to switch between the stowed state and the extended state. When the connecting frame 10 is in the stowed state, an entirety of each of the adjustment assemblies 20 is located in the mounting slot 101*a*, and there is no protrusion on the upper surface of the top plate 101, so which facilitates the stacking and transportation of the cabinet 001 and effectively reduces damage to the adjustment assemblies 20 due to collision. When the connecting frame 10 is in the extended state, the connecting frame 10 extends out of the mounting slot 101*a*, thereby increasing the installation space for installing the optical fiber cables 300 in the third direction Z, facilitating the installation of the optical fiber cables 300, and reducing the bending curvature of the optical fiber cables 300. The sliding member 22 is slidingly connected to the connected to the rotating member 21 to adjust an overall length of each of adjustment assemblies 20, so that when the connecting frame 10 is in the extended state, the overall length of each of adjustment assemblies 20 is adjusted to the minimum, and when the connecting frame 10 is in the extended state, the overall length of each of adjustment assemblies 20 is adjusted to the maximum. Referring to FIG. 3, which shows a related technology, the adjustment assemblies 20 in the related technology has an integrated structure and cannot adjust its length. Four brackets 200 are provided in the mounting slot 101*a*. Referring to FIG. 2, which shows an embodiment of the present disclosure, the length of each of the adjustment assemblies 20 can be adjusted by sliding the sliding member 22 relative to the rotating member 21. Under the condition that the size of the mounting slot 101*a* remains unchanged and the height of the connecting frame 10 remains unchanged when it is in the extended state, six brackets 200 can be installed in the mounting slot 101*a*, and the number of brackets 200 can be increased by 50%, that is, in the cabinet—1 of the same size, the number of optical fiber cables 300 that can be connected to the brackets 200 can be increased by 50%.

In at least one embodiment, referring to FIGS. 4 and 6 to 11, a rotating hole 211 penetrates the rotating member 21 along the second direction Y, a rotating shaft 214 rotatably extends through the rotating hole 211 along the second direction Y and is connected to the inner wall 101*b* defining the mounting slot 101*a*, so that the rotating member 21 can rotate relative to the cabinet body 100.

In at least one embodiment, referring to FIGS. 4 and 6 to 11, the rotating member 21 may include a matching groove 212, and the limiting member 23 may include a clamping block 231. When the sliding member 22 slides to the preset position, the clamping block 231 is embedded into the matching groove 212, thereby limiting and stopping a sliding movement of the sliding member 22 relative to the rotating member 21. The limiting member 23 can elastically deform in a direction away from the rotating member 21 to separate to the clamping block 231 from the matching groove 212.

By a cooperation of the clamping block 231 and the matching groove 212 and a relative displacement between the sliding member 22 and the rotating member 21, the adjustment assemblies 20 can maintain the longest state or the shortest state. When the connecting frame 10 is in the extended state, the corresponding adjustment assembly 20 is in a vertical position, and the sliding direction of the sliding member 22 is the third direction Z, so that when the sliding member 22 is subject to the gravity of the connecting frame 10 and the optical fiber cables 300 connected to the connecting frame 10, the sliding member 22 is easy to retract toward the rotating member 21. By the cooperation of the clamping block 231 and the matching groove 212, the sliding movement of the sliding member 22 is stopped, so that the movement of the optical fiber cables 300 is reduced, thereby helping to reduce the instability of the connection between the connecting frame 10 and each of the optical fiber cables 300 and reduce the excessive bending of the optical fiber cables 300.

In at least one embodiment, the rotating member 21 may include two matching grooves 212, the matching grooves 212 are arranged at intervals in the sliding direction of the sliding member 22.

In at least one embodiment, the limitation of the relative position of the sliding member 22 and the rotating member 21 may be not limited to the way in which the clamping block 231 cooperates with the matching groove 212, it may also be in other ways. For example, the sliding member 22 and the rotating member 21 may be both provided with holes at corresponding positions, the limiting member 23 may be a cylindrical structure, such as a bolt or a pin, and the limiting member 23 is inserted into the holes of the sliding member 22 and the rotating member 21 to limit the relative position of the sliding member 22 and the rotating member 21. For another example, the limiting member 23 may include two magnets attracting each other, one of the magnets is mounted on the sliding member 22, and the other is mounted on the rotating member 21.

Figure 9:
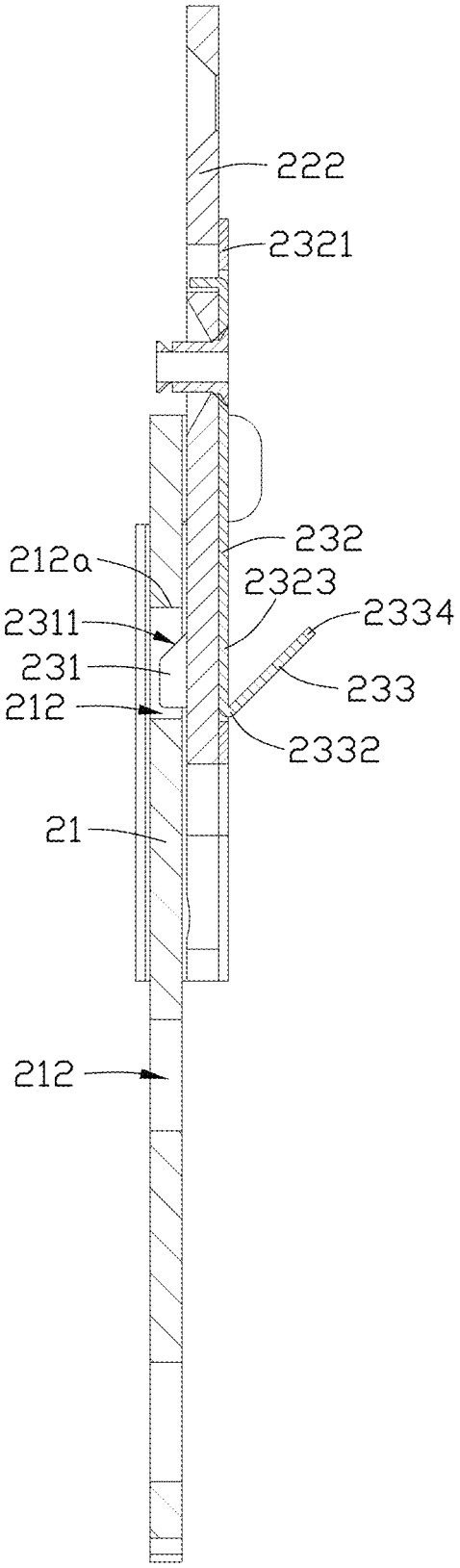
FIG. 9 is a cross-sectional view illustrating the adjustment assembly taken along IX-IX line in FIG. 7.
Figure 10:
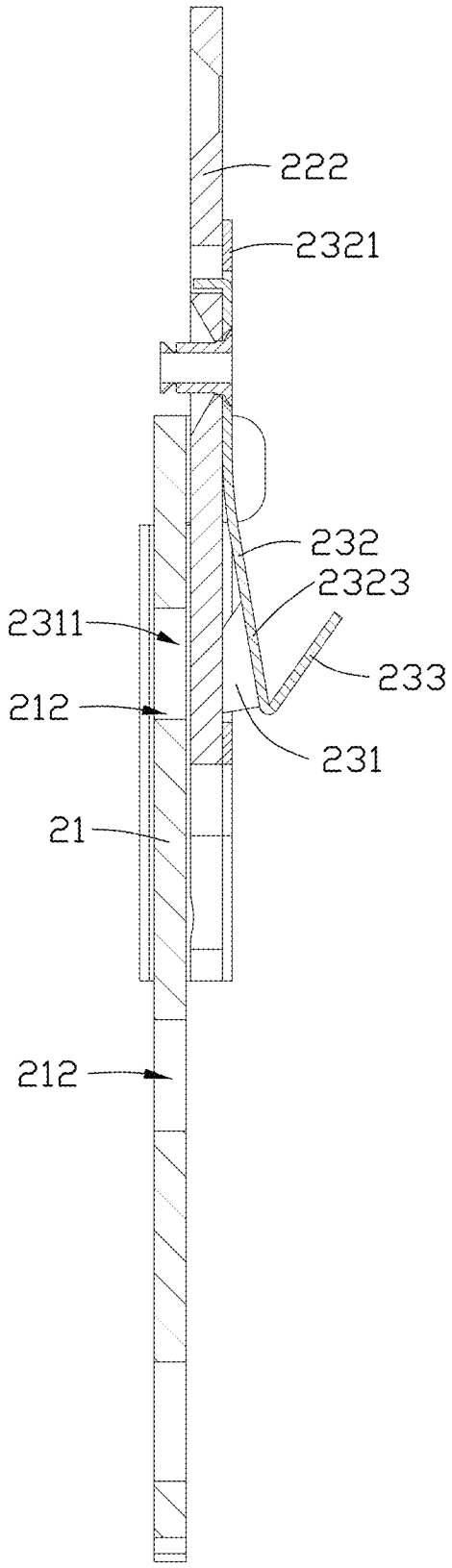
FIG. 10 is a cross-sectional view illustrating the adjustment assembly of FIG. 9 in another state.

Referring to FIG. 9 and FIG. 10, in at least one embodiment, the limiting member 23 may further include an elastic connecting plate 232 and an operating plate 233. In at least one embodiment, the elastic connecting plate 232 may be in a shape of a strip and extend along the sliding direction of the sliding member 22. A first end portion 2321 of the elastic connecting plate 232 is connected to the sliding member 22, and the clamping block 231 is arranged on a second end portion 2323 of the elastic connecting plate 232 away from the first end portion. The operating plate 233 is arranged on the elastic connecting plate 232, and by pulling the operating plate 233, the elastic connecting plate 232 can be elastically deformed so that the second end portion 2323 can be away from the rotating part 21, thereby separating the clamping block 231 from the matching groove 212. When the operating plate 233 is released, the elastic deformation of the elastic connecting plate 232 is restored. The elastic deformation of the elastic connecting plate 232 allows the clamping block 231 to insert into or leave the matching groove 212.

The clamping block 231 may include a guide surface 2311 facing the end of the sliding member 22 connected to the connecting frame 10. When the clamping block 231 is located in the matching groove 212 close to the rotating hole 211 and the adjustment assembly 20 is extended, the guide surface 2311 contacts a wall 212*a* of the matching groove 212, and the wall 212*a* of the matching groove 212 exerts a component force on the guide surface 2311 in the direction away from the rotating member 21, so that the second end portion 2323 of the elastic connecting plate 232 will elastically deform, and as the sliding member 22 slides, the clamping block 231 can be separated from the matching groove 212. When the overall length of each of adjustment assemblies 20 is adjusted to the maximum, an end surface of the clamping block 231 facing away from the guide surface 2311 is at a right angle to the elastic connecting plate 232, and the end surface of the clamping block 231 is in contact with the wall 212*a* of the matching groove 212 to prevent the adjustment assembly 20 from retracting.

In practical applications, the limiting member 23 is mainly used to prevent the sliding member 22 from sliding downward due to the total gravity of the sliding member 22, the connecting frame 10, and the optical fiber cables 300 when the connecting frame 10 is in the extended state and the adjustment assemblies 20 are in the longest state. Secondly, the limiting member 23 is used to prevent the sliding frame from sliding due to shaking during transportation when the connecting frame 10 is in the stowed state and the adjusting assemblies 20 are in the shortest state. Since the inertia generated by the total gravity is relatively large compared to the shaking, when the adjustment assemblies 20 are in the longest state, it needs to maintain better stability to ensure that the adjustment assemblies 20 will not be retracted, and when the adjustment assemblies 20 are in the shortest state, there is no need to excessively restrict the sliding member 22 so that the sliding member 22 can easily extend compared to the rotating member 21.

In at least one embodiment, the limiting member 23 may include two clamping blocks 231, and the clamping blocks 231 may located on opposite sides of the second portion 2323 of the elastic connecting plate 232.

In at least one embodiment, the operating plate 233 may be arranged on the second end portion 2323 to close to the clamping block 231, and the operating plate 233 may be inclined relative to the elastic connecting plate 232. The elastic connecting plate 232 can be deformed more easily through the operating plate 233.

In at least one embodiment, a first end 2332 of the operating plate 233 is connected to the elastic connecting plate 232, a second end 2334 of the operating plate 233 is located a side of the elastic connecting plate 232 away from the sliding member 22, and the second end 2334 of the operating plate 233 is located a side of the first end 2332 of the operating plate 233 close to the connecting frame 10.

Figure 11:
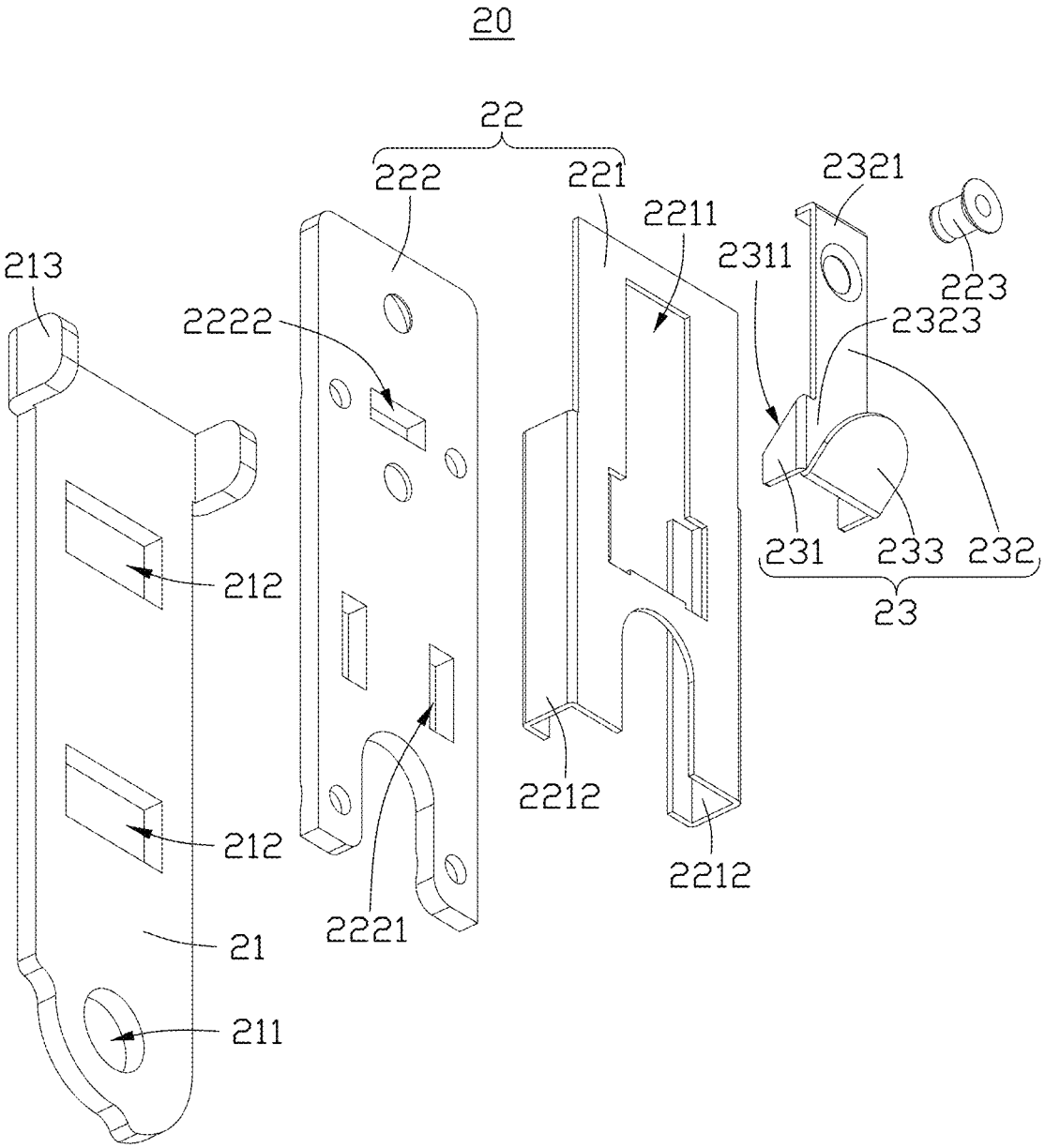
FIG. 11 is an exploded view illustrating an adjustment assembly according to another embodiment of the present disclosure.

Referring to FIG. 11, an escaping groove 2211 is arranged on the sliding member 22 for receiving the limiting member 23, so that the clamping block 231 can insert into the matching groove 212.

The limiting member 23 and the sliding member 22 may be detachably connected. In at least one embodiment, the first end portion 2321 of the elastic connecting plate 232 may be connected to the sliding member 22 through a fastener 223, and the fastener 223 may be a bolt or a rivet.

Figure 8:
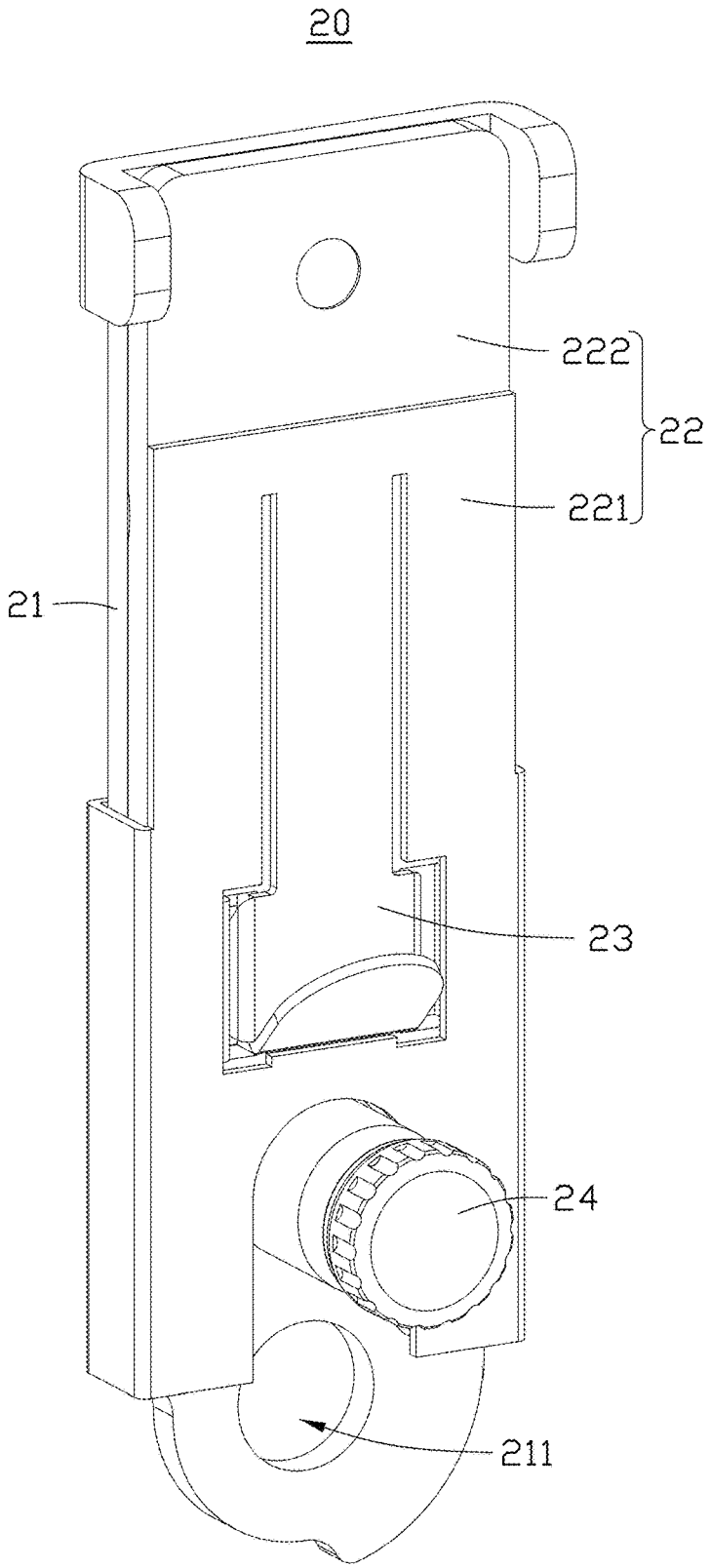
FIG. 8 is a schematic diagram illustrating an adjustment assembly according to another embodiment of the present disclosure.

Referring to FIG. 8, in at least one embodiment, the limiting member 23 and the sliding member 22 may be integrally formed. In at least one embodiment, the first end portion 2321 of the elastic connecting plate 232 may be integrally formed with the sliding member 22.

Referring to FIGS. 8 to 11, the sliding member 22 may include a first sliding plate 221 and a second sliding plate 222. The first sliding plate 221, the second sliding plate 222, and the rotating member 21 are stacked in sequence, the second sliding plate 222 is located between the first sliding plate 221 and the rotating member 21. The escaping groove 2211 is arranged on the first sliding plate 221, and a shape of the escaping groove 2211 is adapted to a shape of the elastic connecting plate 232. The first sliding plate 221 is slidingly connected to the rotating member 21.

An end of the second sliding plate 222 is connected to an end of the connecting frame 10, and the limiting member 23 is used to limit the sliding movement of the second sliding plate 222 relative to the rotating member 21. A through hole 2221 corresponding to each clamping block 231 is arranged in the second sliding plate 222 for passing through the corresponding clamping block 231, so that the clamping block 231 can insert into the matching groove 212. In at least one embodiment, the first end portion 2321 of the elastic connecting plate 232 is bent toward the second sliding plate 222, and a positioning groove 2222 is arranged on the second sliding plate 222. When the limiting member 23 is detachably connected to the sliding member 22, the first end portion 2321 of the elastic connecting plate 232 extends into the positioning groove 2222 to achieve rough positioning. When the limiting member 23 and the sliding member 22 are integrally formed, the first end portion 2321 of the elastic connecting plate 232 may be integrally connected to the second sliding plate 222 or the first sliding plate 221.

The first sliding plate 221 and the second sliding plate 222 may be made of different materials to meet design requirements and reduce costs. For example, the first sliding plate 221 may be made of metal material such as aluminum alloy, and the second sliding plate 222 may be made of rubber, so that the first sliding plate 221 has better strength, which can reduce the occurrence of damage to the first sliding plate 221, and the second sliding plate 222 can reduce weight and cost, and further can reduce friction between the second sliding plate 222 and the rotating member 21, thereby reducing the wear of the rotating member 21.

In at least one embodiment, two guide positioning blocks 213 may be arranged on opposite sides of the rotating member 21, and the sliding member 22 is located between the guide positioning blocks 213.

Two guide rails 2212 may be arranged on opposite sides of the first sliding plate 221, and the rotating member 21 is located between the guide rails 2212. When the guide positioning blocks 213 abut against the guide rails 2212, the sliding member 22 can be prevented from sliding outward. Through the cooperation of the guide positioning blocks 213 and the guide rails 2212, it can not only guide the sliding member 22, but also position the sliding member 22, so that when the adjustment assembly 20 is in the longest state, the sliding member 22 can be prevented from continuing to slide, thereby preventing the sliding member 22 from separating from the rotating member 21.

Figure 12:
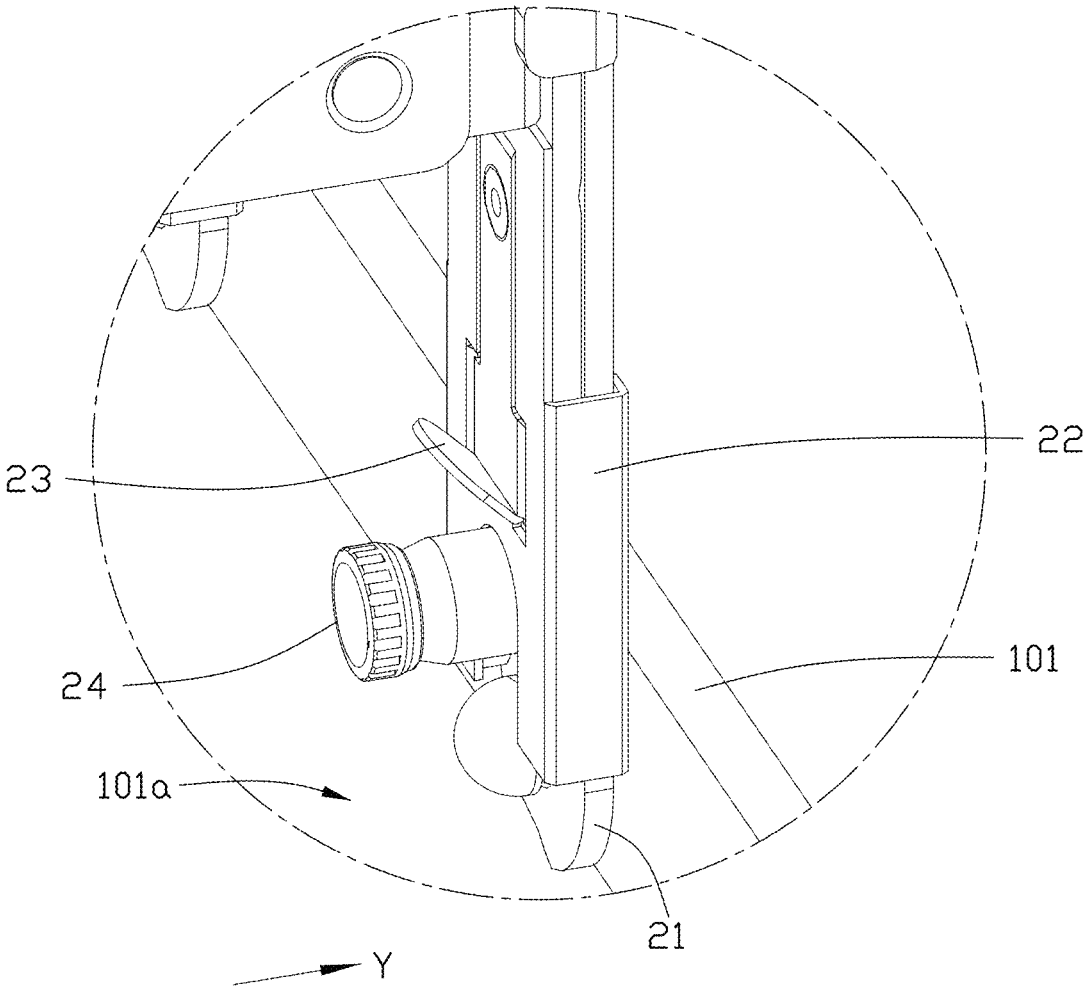
FIG. 12 is a partially enlarged view of an area XII of the partial structure of the cabinet of FIG. 2.

Referring to FIGS. 1, 2, and 12, in at least one embodiment, the adjustment assembly 20 may further include a positioning member 24, the positioning member 24 is arranged on an end of the rotating member 21 away from the connecting frame 10 and protrudes from the rotating member 21. When the positioning member 24 is in contact with the sliding member 22, the sliding member 22 is blocked from retracting and the adjustment assembly 20 is in the shortest state. The positioning member 24 is movably installed on the rotating member 21 along the second direction Y, so the positioning member 24 can also move relative to the rotating member 21 along the second direction Y to abut the cabinet body 100, thereby limiting the rotation of the rotating member 21. That is, the positioning member 24 can not only prevent the sliding member 22 from being separated from the rotating member 21, but also limit the rotation of the rotating member 21, so that the connecting frame 10 can stably maintain the extended state or the stowed state.

The positioning member 24 may be threadedly connected to rotating member 21, so that the positioning member 24 can be inserted into the rotating member 21 and can also move relative the rotating member 21 along the second direction Y.

Figure 13:
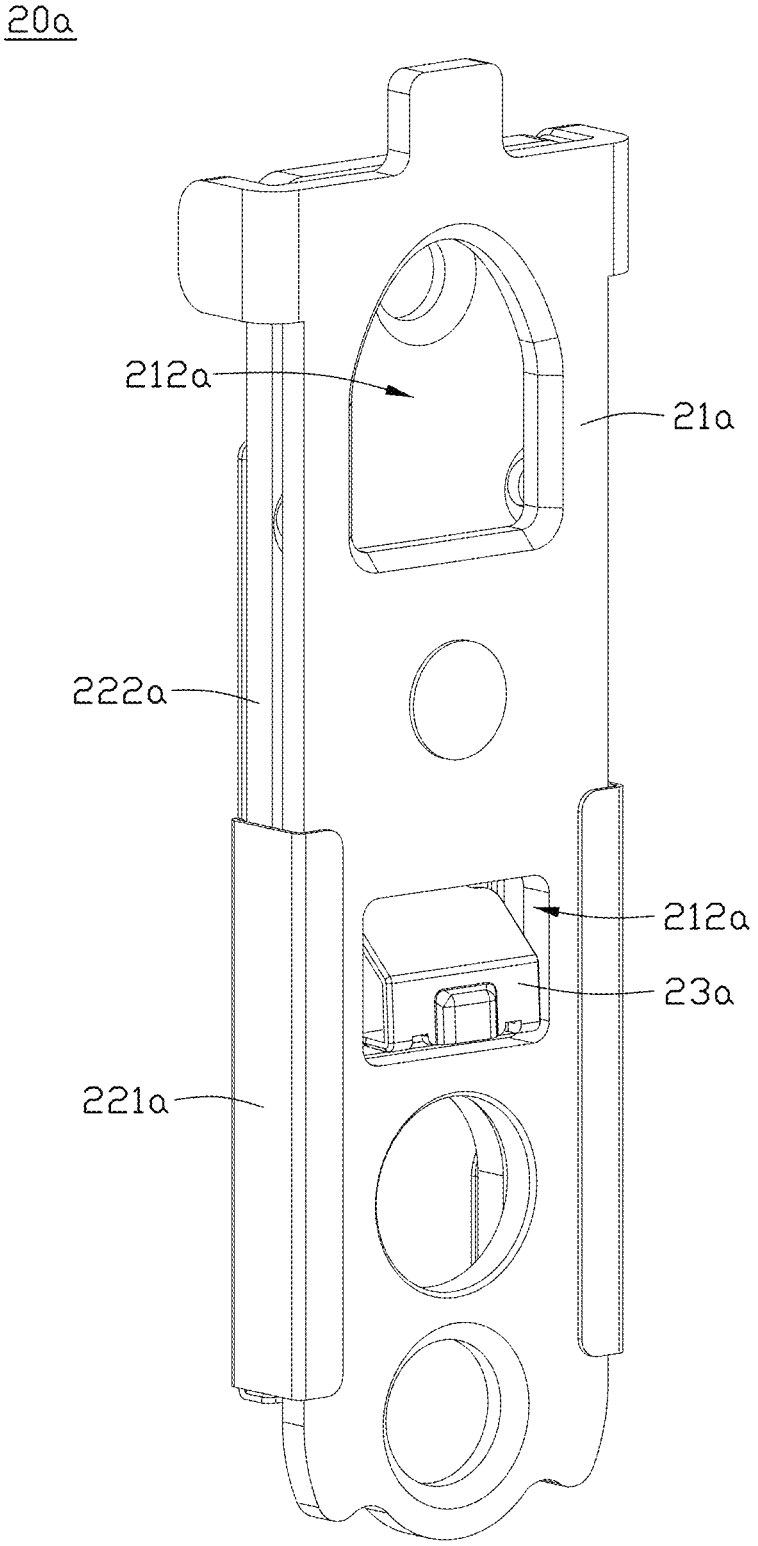
FIG. 13 is a schematic diagram illustrating an adjustment assembly according to another embodiment of the present disclosure.
Figure 14:
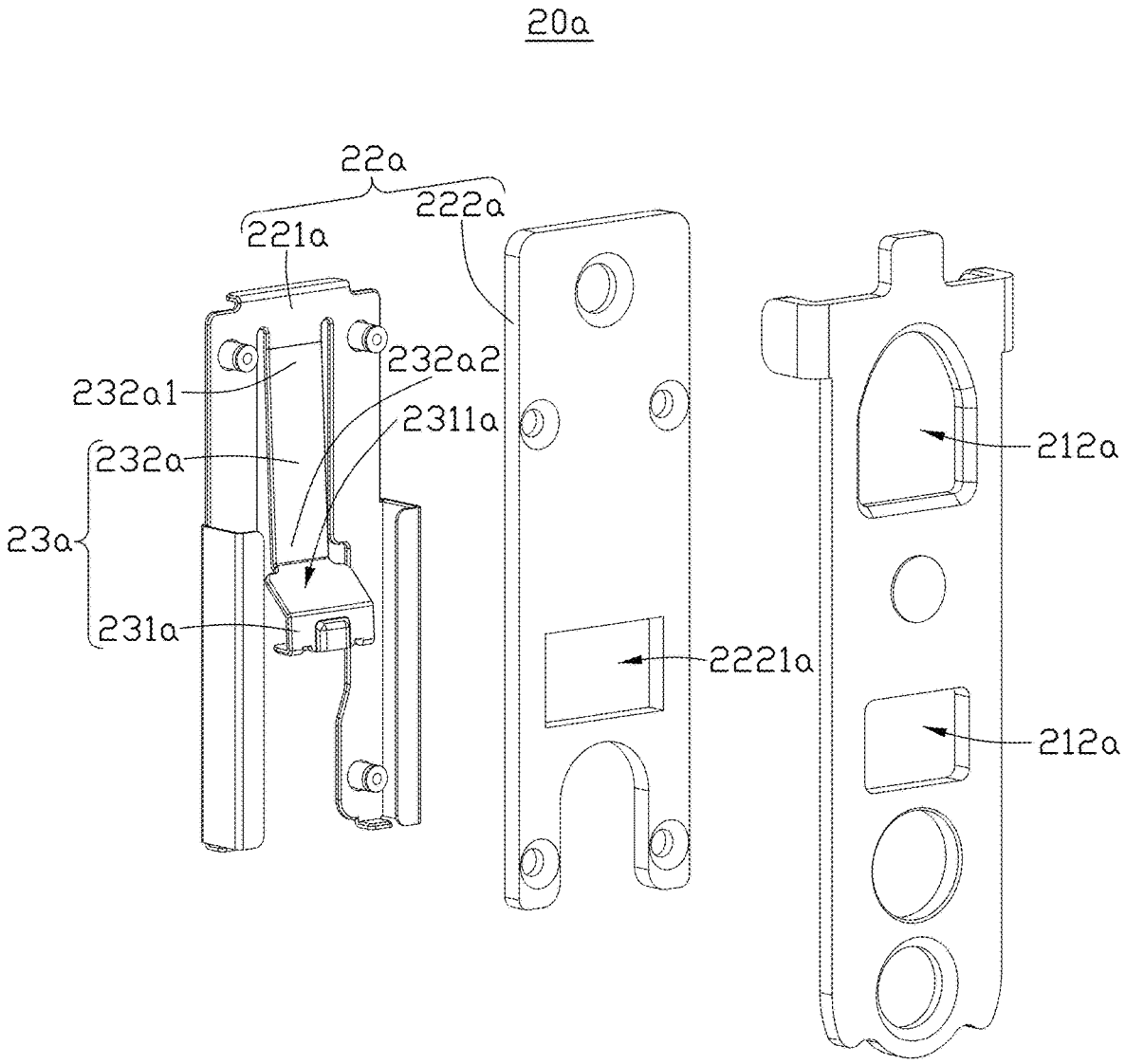
FIG. 14 is an exploded view illustrating the adjustment assembly of FIG. 13.

Referring to FIG. 13 and FIG. 14, another embodiment of an adjustment assembly 20*a* may be provided. The adjustment assembly 20*a* includes a rotating member 21*a*, a sliding member 22*a*, and a limiting member 23*a*. The sliding member 22*a* includes a first sliding plate 221*a* and a second sliding plate 222*a*, the limiting member 23*a* and the first sliding plate 221*a* are integrally formed. The main difference between the adjustment assembly 20*a* and the adjustment assembly 20 is that the position of the rotating member 21*a* is interchanged with the positions of the first sliding plate 221*a* and the limiting member 23*a*, and the structure of the limiting member 23 and the structure of the limiting member 23*a* are different.

In the illustrated embodiment, the rotating member 21*a* is located on a side of the second sliding plate 222*a* away from the connecting frame 10, the first sliding plate 221*a* and the limiting member 23*a* is located on another side of the second sliding plate 222*a* close to the connecting frame 10.

The limiting member 23*a* includes a pressing block 231*a* and an elastic connecting plate 232*a*. A first end 232*al* of the elastic connecting plate 232*a* is connected to the first sliding plate 221*a*, and a second end 232*a*2 of the elastic connecting plate 232*a* is connected to the pressing block 231*a*. Along a direction from the first end 232*al* to the second end 232*a*2, the elastic connecting plate 232*a* gradually tilts toward the rotating member 21*a*, so that the pressing block 231*a* can more easily extend into the through hole 2221*a* and the matching groove 212*a* to limit the relative sliding between the rotating member 21*a* and the sliding member 22*a*. By applying a pressure to the pressing block 231*a*, the pressing block 231*a* is separated from the through hole 2221*a* and the matching groove 212*a*, so that the sliding member 22*a* and the limiting member 23*a* can slide relative to the rotating member 21*a*. A size of the matching groove 212*a* is greater than a size of the pressing block 231*a*, so that when the user presses the pressing block 231*a* with a finger, part of the finger can extend into the matching groove 212*a*, thereby improving the user's comfort and user experience.

Since the internal space of the cabinet 001 is small, the optical fiber cables 300 are numerous and densely arranged, and the optical fiber cables 300 cannot be greatly bent, so that the method of controlling the length of the adjustment assemblies 20 and 20*a* should be as simple as possible and occupy as little space as possible. By pressing the pressing block 231*a*, the limitation of the sliding member 22*a* is released, which is not only easy to operate and labor-saving, but also when the pressing block 231*a* is pressed, the pressing block 231*a* approaches the direction of the connecting frame 10, which does not increase the occupied space, and the pressing block 231*a* will not be unable to move due to the obstruction of the optical fiber cables 300.

The use process of the cabinet 001 in the present disclosure is as follows: the bracket 200 is rotated to drive the connecting frame 10 from the stowed state to the extended state, and the positioning member 24 is rotated until the positioning member 24 abuts against the cabinet body 100 to limit the rotation of the rotating member 21. An upward pulling force is applied to the connecting frame 10 so that the sliding member 22 extends out of the rotating member 21, and then the clamping block 231 extends into the matching groove 212 to limit the movement of the sliding member 22. Finally, the optical fiber cables 300 are installed.

It is to be understood, even though information and advantages of the present embodiments have been set forth in the foregoing description, together with details of the structures and functions of the present embodiments, the disclosure is illustrative only; changes may be made in detail, especially in matters of shape, size, and arrangement of parts within the principles of the present embodiments to the full extent indicated by the plain meaning of the terms in which the appended claims are expressed.

What is claimed is:

1. A cabinet, comprising:

a cabinet body; and a bracket comprising:

a connecting frame; and two adjustment assemblies;

wherein each of the adjustment assemblies comprises a first end and a second end away from the first end, the first end of each of the adjustment assemblies is connected to the connecting frame, the second end of each of the adjustment assemblies is rotatably connected to the cabinet body, a distance between the first end and the second end of each of the adjustment assemblies is adjustable;

each of the adjustment assemblies further comprises a rotating member, a sliding member, and a limiting member, the rotating member comprises the second end rotatably connected to the cabinet body, the sliding member is slidingly connected to the rotating member to adjust the distance between the first end and the second end of each of the adjustment assemblies, the sliding member comprises the first end connected to the connecting frame, the limiting member is arranged on the sliding member, and when the sliding member slides relative to the rotating member to a preset position, the limiting member and the rotating member are limitedly engaged.

2. The cabinet of claim 1, wherein the cabinet body comprises a mounting slot, the connecting frame rotates between a first position and a second position through the adjustment assemblies, when the connecting frame is located in the first position, the connecting frame is received in the mounting slot, and when the connecting frame is located in the second position, the connecting frame is located outside the mounting slot.

3. The cabinet of claim 1, wherein each of the adjustment assemblies further comprises a positioning member, the positioning member is arranged on an end of the rotating member away from the connecting frame, the positioning member is configured for positioning the sliding member.

4. The cabinet of claim 1, wherein the limiting member comprises a clamping block, the rotating member further comprises a matching groove configured for receiving the clamping block, and the limiting member is elastically deformable such that the clamping block is detachably clamped with the matching groove.

5. The cabinet of claim 4, wherein each of the adjustment assemblies further comprises a positioning member, the positioning member is arranged on an end of the rotating member away from the connecting frame, the positioning member is configured for positioning the sliding member.

6. The cabinet of claim 4, wherein the limiting member further comprises an elastic connecting plate and an operating plate, the elastic connecting plate comprises a first end portion and a second end portion away from the first end portion, the first end portion of the elastic connecting plate is connected to the sliding member, the clamping block is arranged on the second end portion of the elastic connecting plate, the operating plate is arranged on the elastic connecting plate and the operating plate is configured for driving the elastic connecting plate to elastically deform such that the clamping block is separated from the matching groove.

7. The cabinet of claim 6, wherein each of the adjustment assemblies further comprises a positioning member, the positioning member is arranged on an end of the rotating member away from the connecting frame, the positioning member is configured for positioning the sliding member.

8. The cabinet of claim 6, wherein the operating plate is arranged on the second end portion of the elastic connecting plate, and the operating plate is inclined relative to the elastic connecting plate.

9. The cabinet of claim 8, wherein each of the adjustment assemblies further comprises a positioning member, the positioning member is arranged on an end of the rotating member away from the connecting frame, the positioning member is used to position the sliding member.

10. The cabinet of claim 6, wherein the clamping block comprises a guide surface facing the first end of the sliding member.

11. The cabinet of claim 10, wherein each of the adjustment assemblies further comprises a positioning member, the positioning member is arranged on an end of the rotating member away from the connecting frame, the positioning member is configure for positioning the sliding member.

12. The cabinet of claim 1, wherein two guide positioning blocks are arranged on opposite sides of the rotating member, and the sliding member is located between the guide positioning blocks, two guide rails are arranged on opposite sides of the sliding member, and the rotating member is located between the guide rails, the guide positioning blocks are configured for cooperating with the guide rails to prevent the sliding member from sliding outward.

13. The cabinet of claim 12, wherein each of the adjustment assemblies further comprises a positioning member, the positioning member is arranged on an end of the rotating member away from the connecting frame, the positioning member is configured for positioning the sliding member.

14. The cabinet of claim 12, wherein the sliding member comprises a first sliding plate and a second sliding plate, the guide rails are arranged on the first sliding plate, the second sliding plate is located between the first sliding plate and the rotating member, an end of the second sliding plate is connected to an end of the connecting frame, and the limiting member is configured for limiting a sliding movement of the second sliding plate relative to the rotating member.

15. The cabinet of claim 14, wherein each of the adjustment assemblies further comprises a positioning member, the positioning member is arranged on an end of the rotating member away from the connecting frame, the positioning member is configured for positioning the sliding member.

* * * * *